US009388354B2

(12) United States Patent
Walter

(10) Patent No.: US 9,388,354 B2
(45) Date of Patent: Jul. 12, 2016

(54) TERTIARY AMINES FOR REDUCING INJECTOR NOZZLE FOULING AND MODIFYING FRICTION IN DIRECT INJECTION SPARK IGNITION ENGINES

(71) Applicant: BASF SE, Ludwigshafen (DE)

(72) Inventor: Marc Walter, Frankenthal (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/071,814

(22) Filed: Nov. 5, 2013

(65) Prior Publication Data

US 2014/0123547 A1 May 8, 2014

Related U.S. Application Data

(60) Provisional application No. 61/722,801, filed on Nov. 6, 2012.

(51) Int. Cl.

| | |
|---|---|
| ***C10L 1/22*** | (2006.01) |
| ***C10L 1/222*** | (2006.01) |
| ***C10L 1/238*** | (2006.01) |
| ***C10L 1/2383*** | (2006.01) |
| ***C10L 10/08*** | (2006.01) |

(52) U.S. Cl.

CPC ..... *C10L 1/2222* (2013.01); *C10L 1/221* (2013.01); *C10L 1/238* (2013.01); *C10L 1/2383* (2013.01); *C10L 10/08* (2013.01); *C10L 2200/0423* (2013.01); *C10L 2270/023* (2013.01)

(58) Field of Classification Search

CPC ..... C10L 1/2222; C10L 1/221; C10L 1/238; C10L 1/2383; C10L 10/08

USPC ..... 44/412, 415

See application file for complete search history.

(56) References Cited

U.S. PATENT DOCUMENTS

| | | | | |
|---|---|---|---|---|
| 2,782,240 | A | 2/1957 | Hefner et al. | |
| 2,841,479 | A | 7/1958 | Hefner et al. | |
| 3,707,362 | A * | 12/1972 | Zimmerman et al. | 44/412 |
| 4,152,499 | A | 5/1979 | Boerzel et al. | |
| 4,409,000 | A * | 10/1983 | LeSuer | 44/386 |
| 4,605,808 | A | 8/1986 | Samson | |
| 4,877,416 | A | 10/1989 | Campbell | |
| 6,723,141 | B1 * | 4/2004 | Kendall | 44/387 |
| 8,449,630 | B2 * | 5/2013 | Lange et al. | 44/412 |
| 2003/0079399 | A1 | 5/2003 | Malfer et al. | |
| 2006/0242893 | A1 | 11/2006 | Malfer et al. | |
| 2008/0034647 | A1 * | 2/2008 | Cunningham et al. | 44/412 |
| 2008/0282607 | A1 | 11/2008 | Dietz et al. | |
| 2009/0307965 | A1 | 12/2009 | Vilardo | |
| 2012/0137573 | A1 | 6/2012 | Voelkel et al. | |
| 2013/0125452 | A1 | 5/2013 | Schwahn et al. | |
| 2013/0312320 | A1 | 11/2013 | Walter | |
| 2014/0020285 | A1 | 1/2014 | Voelkel et al. | |

FOREIGN PATENT DOCUMENTS

| | | | |
|---|---|---|---|
| DE | 659210 | C | 4/1938 |
| DE | 38 38 918 | A1 | 5/1990 |
| DE | 101 02 913 | A1 | 7/2002 |
| EP | 0 244 616 | A2 | 11/1987 |
| EP | 0 310 875 | A1 | 4/1989 |
| EP | 0 356 725 | A1 | 3/1990 |
| EP | 0 385 633 | A1 | 9/1990 |
| EP | 0 700 985 | A1 | 3/1996 |
| EP | 0 831 141 | A1 | 3/1998 |
| EP | 0 869 163 | A1 | 10/1998 |
| EP | 1 155 102 | A | 11/2001 |
| EP | 1 293 553 | A2 | 3/2003 |
| GB | 2 260 337 | A | 4/1993 |
| WO | WO 90/10051 | A1 | 9/1990 |
| WO | WO 92/14805 | A1 | 9/1992 |
| WO | WO 00/47698 | A1 | 8/2000 |
| WO | WO 02/079353 | A1 | 10/2002 |
| WO | WO 03/076554 | A1 | 9/2003 |
| WO | WO 03/083020 | A2 | 10/2003 |
| WO | WO 2004/050806 | A2 | 6/2004 |
| WO | WO 2006/015800 | A1 | 2/2006 |
| WO | WO 2007/053787 | A1 | 5/2007 |
| WO | WO 2008/082916 | A1 | 7/2008 |
| WO | WO 2008/115939 | A1 | 9/2008 |
| WO | WO 2009/050256 | A1 | 4/2009 |
| WO | WO 2009/074608 | A1 | 6/2009 |
| WO | WO 2013/174619 | A1 | 11/2013 |

OTHER PUBLICATIONS

International Search Report and Written Opinion issued Feb. 26, 2014 in PCT/EP2013/072052.

* cited by examiner

*Primary Examiner* — Cephia D Toomer

(74) *Attorney, Agent, or Firm* — Oblon, McClelland, Maier & Neustadt, L.L.P

(57) ABSTRACT

Use of a tertiary hydrocarbyl amine with $C_1$- to $C_{20}$-hydrocarbyl residues, the overall number of carbon atoms not exceeding 30, as an additive in gasoline for reducing injector nozzle fouling and modifying friction in direct injection spark ignition engines. A fuel additive composition essentially comprising nitrogen-containing dispersants, carrier oils, the above tertiary hydrocarbyl amines and optionally further friction modifiers. A fuel composition comprising a major amount of gasoline and a minor amount of the above fuel additive composition.

8 Claims, No Drawings

TERTIARY AMINES FOR REDUCING INJECTOR NOZZLE FOULING AND MODIFYING FRICTION IN DIRECT INJECTION SPARK IGNITION ENGINES

The present invention relates to the use of a special tertiary hydrocarbyl amine as an additive in an unleaded gasoline composition suitable in spark ignition engines, for reducing injector nozzle fouling and modifying friction in direct injection spark ignition engines. Furthermore, the present invention relates to a novel fuel additive composition comprising selected nitrogen-containing dispersants, eventually carrier oils, the above-mentioned tertiary hydrocarbyl amines and, optionally, further friction modifiers. Furthermore, the present invention relates to a gasoline fuel composition comprising a minor amount of the said fuel additive composition.

TECHNICAL BACKGROUND

Modern gasolines are unleaded in order to be compatible with catalytic convertors, and fuel injection has to be used in modern spark ignition engines, in order to achieve the required stoichiometric fuel/air mixtures. A typical fuel-injected spark ignition engine has multipoint fuel injection, in which fuel from the injectors impinges directly onto inlet valves. An unleaded base gasoline in such an engine tends to give rise to inlet valve deposits. A relatively new class of spark ignition engines is the class described as direct injection spark ignition engines, also known as gasoline direct injection engines; problems in such direct injection engines can arise with unleaded gasoline by fouling of injector nozzles.

For trouble-free running, modern direct injection spark ignition engines require automotive fuels having a complex set of properties which can only be guaranteed when use is made of appropriate gasoline additives. Such fuels usually consist of a complex mixture of chemical compounds and are characterized by physical parameters. Fuel additives are used among other things in order to avoid formation of deposits in the intake system and the intake valves of engines (keep-clean effect); on the other hand, fuel additives may be used in order to remove deposits already formed at the valves and in the intake system (clean-up effect). Special additives have been developed to reduce or minimise inlet valve deposits and also injector nozzle fouling.

Aliphatic primary, secondary and tertiary monoamines with $C_1$- to $C_{20}$-alkyl residues, $C_3$- to $C_{20}$-cycloalkyl residues or cycloalkyl residues are known as dispersant additives in gasoline fuels, preferably in combination with Mannich-type dispersant additives, from WO 04/050806. The said monoamines can be used in gasoline fuels together with other dispersants additives, such as polyisobutenyl monoamines or polyisobutenyl polyamines based on polyisobutene with a number average molecular weight of from 600 to 5000, and with polyether carrier oils, such as tridecanol butoxylate or isotridecanol butoxylate. The use of the said monoamines results in a reduction of injector nozzle fouling in direct injection spark ignition engines.

WO 03/076554 relates to the use of primary hydrocarbyl amines wherein the hydrocarbyl moiety has a number average molecular weight in the range of from 140 to 255 for reducing injector nozzle fouling in direct injection spark ignition engines, either for "keep clean" or for "clean-up" purposes of such engines. In Fuel D of the examples of WO 03/076554, a gasoline fuel was prepared by "dosing into the base fuel 645 ppmw of a commercial additive package ex BASF A.G., containing polyisobutylene monoamine (PIBA), in which the polyisobutylene (PIB) chain has a number average molecular weight (Mn) of approximately 1000, a polyether carrier fluid and an antioxidant, with further inclusion of 50 ppmw dodecylamine". Fuel D was subjected to a clean-up test determining the average injector diameter reduction after running a direct injection spark ignition engine with this Fuel.

WO 90/10051 relates to a gasoline fuel composition containing an intake valve deposit control additive formulation comprising long-chain primary amines exhibiting typically $C_6$-$C_{40}$ aliphatic radicals as substituents, e.g. dodecyl amine (lauryl amine), in combination with fuel dispersants selected from polyalkenylamines (such as polyisobutyl amine) and Mannich bases, and with fluidizer oils such as refined napthenic lubricating oil or a polyolefin like polypropylene or polybutylene.

WO 2009/074608 relates to a fuel additive composition and to a fuel composition comprising nitrogen-containing dispersants selected from polyisobutenyl monoamines and polyisobutenyl polyamines, synthetic or mineral carrier oils and primary, secondary or tertiary amines. Suitable tertiary amines may exhibit three $C_1$- to $C_{30}$-hydrocarbyl residues, the majority of the examples listed for such tertiary amines exhibit three identical $C_1$- to $C_{30}$-hydrocarbyl residues, furthermore, N-methyldicyclohexylamine and N-ethyl-dicyclohexylamine are mentioned. The said amines are recommended as an intake valve clean-up booster in gasoline-operated port fuel injection internal combustion engines.

GB-A 2 260 337 relates to an fuel additive composition for dehazing distillate fuels such as diesel fuels which contain water, said composition comprising an alkoxylated amine such as an ethoxylated fatty amine, e.g. an ethoxylated cocoalkylamine, an ethoxylated tallowalkylamine, an ethoxylated soyaalkylamine or an ethoxylated octadecylamine.

WO 92/14805 relates to a motor fuel composition comprising a liquid fuel in the gasoline boiling range and an amount, sufficient to provide intake system cleanliness especially with port fuel injectors and intake valves, of a mixture of certain amino phenols and certain alkoxylated amines. The alkoxylated amines may be selected from ethoxylated fatty amines, e.g. based on coconut oil, soybean oil or tallow oil, exhibiting oleyl or stearyl radicals.

WO 02/079353 relates to a gasoline additive concentrate composition, comprising a solvent, an alkoxylated fatty amine and a partial ester having at least one free hydroxyl group and formed by reacting a fatty carboxylic acid and a polyhydric alcohol. Examples of alkoxylated fatty amines include diethoxylated tallowamine, diethoxylated oleylamine and diethoxylated stearyl amine. A typical example of a partial ester having at least one free hydroxyl group and formed by reacting a fatty carboxylic acid and a polyhydric alcohol is glycerol monooleate. The said gasoline additive concentrate composition increases fuel economy, reduces fuel consumption, reduces combustion emissions and decreases engine wear in gasoline internal combustion engines.

WO 03/083020 relates to a method of operating a spark-ignited or compression-ignited internal combustion engine, comprising introducing a nitrogen-containing detergent composition selected from (A) reaction products of a hydrocarbyl-substituted acylating agent and an amine, (B) hydrocarbyl-substituted amines, (C) Mannich reaction products and (D) polyetheramines. Detergent composition (B) may include hydroxyl-substituted fatty amines such as diethoxylated tallowamine, diethoxylated oleylamine, diethoxylated stearylamine or diethoxylated amines from soybean oil fatty acids.

WO 2008/115939 relates to a fuel additive concentrate, comprising a detergent, an antioxidant and a friction modifier including alkoxylated fatty amines such as diethoxylated tallowamine, diethoxylated oleylamine, diethoxylated stearylamine or diethoxylated amines from soybean oil fatty acids. The said fuel additive concentrate is recommended for use in nonhydrocarbonaceous fuels.

The performance of the additives of the art to reduce or minimise inlet valve deposits and/or injector nozzle fouling in direct injection spark ignition engines and their interrelationship with gasoline fuels and further fuel additives in fuel compositions may still be unsatisfactory. Furthermore, minimizing friction in direct injection spark ignition engines may also be unsatisfactory. It is, therefore, an object of the present invention to provide an improved additive for reducing inlet valve deposits and/or injector nozzle fouling and for modifying friction, and to provide an improved fuel additive formulation which allow an efficient control of deposits formed in the engine, especially an improved injector nozzle fouling clean-up and keep-clean performance, and of friction performance.

BRIEF DESCRIPTION OF THE INVENTION

It has now been observed that the use of an effective concentration of a tertiary hydrocarbyl amine of formula (I)

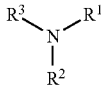

(I)

wherein $R^1$, $R^2$ and $R^3$ are the same or different $C_1$- to $C_{20}$-hydrocarbyl residues with the proviso that the overall number of carbon atoms in formula (I) does not exceed 30, as an additive in an unleaded gasoline composition suitable in spark ignition engines, reduces injector nozzle fouling in direct injection spark ignition engines.

Moreover, it has now been observed that a fuel additive composition essentially comprising:

(A) at least one nitrogen-containing dispersant selected from (A1) polyisobutenyl monoamines, (A2) polyisobutenyl polyamines, (A3) Mannich reaction products of substituted phenols with aldehydes and mono- or polyamines and (A4) polyoxyalkylenes which are terminated by mono- or polyamino groups;

(B) in case of presence of (A1), (A2) or (A3), at least one carrier oil which is substantially free of nitrogen, selected from synthetic carrier oils and mineral carrier oils;

(C) at least one tertiary hydrocarbyl amine of formula (I) as described herein

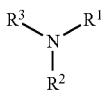

(I)

wherein $R^1$, $R^2$ and $R^3$ are the same or different $C_1$- to $C_{20}$-hydrocarbyl residues with the proviso that the overall number of carbon atoms in formula (I) does not exceed 30; and (D) optionally, at least one further friction modifier, still further reduces injector nozzle fouling and still further minimizes friction in direct injection spark ignition engines. Therefore, the said fuel additive composition is also a subject matter of the instant invention.

A further subject matter of the instant invention is a fuel composition comprising a major amount of a liquid fuel in gasoline boiling range and a minor amount of the above fuel additive composition.

DETAILS DESCRIPTION OF THE INVENTION AND PREFERRED EMBODIMENTS

The Nitrogen-Containing Dispersant (Component A)

The polyisobutenes which are suitable for preparing the polyisobutenyl monoamines (A1) and polyisobutenyl polyamines (A2) used in the present invention include polyisobutenes which comprise at least about 20%, preferably at least 50% and more preferably at least 70% of the more reactive methylvinylidene isomer. Suitable polyisobutenes include those prepared using $BF_3$ catalysts. The preparation of such polyisobutenes in which the methylvinylidene isomer comprises a high percentage of the total composition is for example described in U.S. Pat. No. 4,152,499 and U.S. Pat. No. 4,605,808.

Examples of suitable polyisobutenes having a high alkylvinylidene content include Ultravis® 30, a polyisobutene having a number average molecular weight of about 1300 and a methylvinylidene content of about 74%, and Ultravis® 10, a 950 molecular weight polyisobutene having a methylvinylidene content of about 76%, both available from British Petroleum. Another example of a suitable polyisobutene having a number average molecular weight of about 1000 and a high methylvinyliden content is Glissopal® 1000, available from BASF SE.

In most instances, the polyisobutene precursors are not a pure single product, but rather a mixture of compounds having an average molecular weight in the above range. Usually, the range of molecular weights will be relatively narrow having a maximum near the indicated molecular weight.

The amine component of the polyisobutenyl monoamines or polyisobutenyl polyamines, respectively, may be derived from ammonia, a monoamine or a polyamine.

The monoamine or polyamine component comprises amines having from 1 to about 12 amine nitrogen atoms and from 1 to 40 carbon atoms. The carbon to nitrogen ratio may be between about 1:1 and about 10:1. Generally, the monoamine will contain from 1 to about 40 carbon atoms and the polyamine will contain from 2 to about 12 amine nitrogen atoms and from 2 to about 40 carbon atoms.

The amine component may be a pure single product or a mixture of compounds having a major quantity of the designated amine.

When the amine component is a polyamine, it will preferably be a polyalkylene polyamine, including alkylene diamine. Preferably, the alkylene group will contain from 2 to 6 carbon atoms, more preferably from 2, 3 or 4 carbon atoms. Examples of such polyamines include ethylene diamine, diethylene triamine, triethylene tetramine and tetraethyl-ene pentamine. Preferred polyamines are ethylene diamine and diethylene triamine.

Particularly preferred polyisobutenyl polyamines include polyisobutenyl ethylene diamine and polyisobutenyl amine. The polyisobutenyl group is substantially saturated.

The polyisobutenyl monoamines or polyisobutenyl polyamines employed in the fuel additive composition of the instant invention are prepared by conventional procedures known in the art, especially by reductive amination. Such polyisobutenyl monoamines or polyisobutenyl polyamines and their preparations are described in detail e.g. in EP-A 0 244 616.

The amine portion of the molecule may carry one or more substituents. Thus, the carbon and/or, in particular, the nitrogen atoms of the amine may carry substituents selected from hydrocarbyl groups of from 1 to about 10 carbon atoms, acyl groups of from 2 to about 10 carbon atoms, and monoketo, monohydroxy, mononitro, monocyano, lower alkyl and lower alkoxy derivatives thereof. "Lower" as used herein means a group containing from 1 to about 6 carbon atoms. At least one of hydrogen atoms on one of the basic nitrogen atoms of the polyamine may not be substituted so that at least one of the basic nitrogen atoms of the polyamine is a primary or secondary amino nitrogen.

A polyamine finding use within the scope of the present invention as amine component for the polyisobutenyl polyamines may be a polyalkylene polyamine, including substituted polyamines, e.g., alkyl and hydroxyalkyl-substituted polyalkylene polyamine. Among the polyalkylene polyamines, those containing 2 to 12 amino nitrogen atoms and 2 to 24 carbon atoms should be mentioned, in particular $C_2$- to $C_3$-alkylene polyamines. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, and 1,3,2-hydroxypropylene.

Examples of such polyamines comprise 1,2-ethylene diamine, diethylene triamine, di(trimethylene) triamine, 1,2-propylene diamine, 1,3-propylene diamine, dipropylene triamine, triethylene tetraamine, tripropylene tetraamine, tetraethylene pentamine, pentaethylene hexamine, hexamethylene diamine and dimethylaminopropylene diamine. Such amines encompass isomers such as branched-chain polyamines and previously-mentioned substituted polyamines, including hydroxy- and hydrocarbyl-substituted polyamines.

The amine component for the polyisobutenyl monoamines or polyisobutenyl polyamines also may be derived from heterocyclic polyamines, heterocyclic substituted amines and substituted heterocyclic compounds, wherein the heterocycle comprises one or more 5- to 6-membered rings containing oxygen and/or nitrogen. Such heterocyclic rings may be saturated or unsaturated and substituted with groups as defined above.

As examples of heterocyclic compounds there may be mentioned 2-methylpiperazine, N-(2-hydroxyethyl)-piperazine, 1,2-bis-(N-piperazinyl)ethane, N,N'-bis(N-piperazinyl)-piperazine, 2-methylimidazoline, 3-aminopiperidine, 3-aminopyridine, N-(3-amino-propyl)-morpholine, N-(betaaminoethyl)piperazine, N-(betaaminoethyl)piperidine, 3-amino-N-ethylpiperidine, N-(betaaminoethyl) morpholine, N,N'-di(beta-aminoethyl)-piperazine, N,N'-di(betaaminoethyl)imidazolidone-2,1,3-dimethyl-5(beta-amino-ethyl) hexahydrotriazine, N-(betaaminoethyl)-hexahydrotriazine, 5-(beta-aminoethyl)-1,3,5-dioxazine.

Alternatively, the amine component for the polyisobutenyl monoamines may be derived from a monoamine having the formula $HNR^4R^5$ wherein $R^4$ and $R^5$ are independently selected from the group consisting of hydrogen and hydrocarbyl of 1 to about 20 carbon atoms and, when taken together, $R^4$ and $R^5$ may form one or more 5- or 6-membered rings containing up to about 20 carbon atoms. Preferably, $R^4$ is hydrogen and $R^5$ is a hydrocarbyl group having 1 to about 10 carbon atoms. More preferably, $R^4$ and $R^5$ are hydrogen. The hydrocarbyl groups may be straight-chain or branched and may be aliphatic, alicyclic, aromatic or combinations thereof. The hydrocarbyl groups may also contain one or more oxygen atoms.

Typical primary amines are exemplified by N-methylamine, N-ethylamine, N-n-propyl-amine, N-isopropylamine, N-n-butylamine, N-isobutylamine, N-sec.-butylamine, N-tert-butylamine, N-n-pentylamine, N-cyclopentylamine, N-n-hexylamine, N-cyclohexyl-amine, N-octylamine, N-decylamine, N-dodecylamine, N-octadecylamine, N-benzyl-amine, N-(2-phenylethyl)amine, 2-aminoethanol, 3-amino-1-proponal, 2-(2-amino-ethoxy)ethanol, N-(2-methoxyethyl)amine, N-(2-ethoxyethyl)amine, and the like. Preferred primary amines are N-methylamine, N-ethylamine and N-n-propylamine.

Typical secondary amines include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di-(2-hydroxy-ethyl)amine, N,N-di(3-hydroxypropyl)amine, N,N-di(ethoxyethyl)amine, N,N-di-(propoxyethyl)amine, and the like. Preferred secondary amines are N,N-dimethylamine, N,N-diethylamine and N,N-di-n-propylamine.

Cyclic secondary amines may also be employed to form the polyisobutenyl monoamines or polyisobutenyl polyamines used in the instant invention. In such cyclic compounds, $R^4$ and $R^5$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine, and the like.

The number average molecular weight of the polyisobutenyl monoamines or polyisobutenyl polyamines used in the instant invention is usually in the range of from 500 to 2500, typically about 550, about 750, about 1000 or about 1300. A preferred range for the number average molecular weight of the polyisobutenyl monoamines or polyisobutenyl polyamines is from 550 to 1000. As already stated for the polyisobutene precursors, the polyisobutenyl monoamines or polyisobutenyl polyamines are mostly not pure single products, but rather mixtures of compounds having number average molecular weights as indicated above. Usually, the range of molecular weights will be relatively narrow having a maximum near the indicated molecular weight.

In an especially preferred embodiment, dispersant component (A) is a polyisobutenyl monoamine (A1) with a number average molecular weight of from 550 to 1000. The said polyisobutenyl monoamine is preferably based on ammonia and preferably prepared via hydroformylation of polyisobutene and subsequent reductive amination with ammonia, as described in EP-A 0 244 616.

The Mannich reaction products of substituted phenols with aldehydes and mono- or polyamines (A3) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having a number average molecular weight of from 300 to 5000. Such "polyisobutene-Mannich bases" are described in particular in EP-A 831 141.

The polyoxyalkylenes which are terminated by mono- or polyamino groups (A4), which are also called "polyetheramines", are obtainable by reaction of $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with from 1 to 30 mol of ethylene oxide and/or propylene oxide and/or butylene oxide per hydroxyl group or amino group and by subsequent reductive amination with ammonia, monoamines or polyamines. Such products are described in particular in EP-A 310 875, EP-A 356 725, EP-A 700 985 and U.S. Pat. No. 4,877,416. In most cases, such products also have carrier oil properties. Typical examples of these are the corresponding reaction products of tridecanol butoxylates, isotridecanol butoxylates, isononylphenol butoxylates and polyisobutenol butoxylates and propoxylates with ammonia.

The Carrier Oil (Component B)

The fuel-soluble, nonvolatile carrier oil of component (B) is to be used as a necessary part of the fuel additive composition of the instant invention only in combination with components (A1), (A2) and (A3), in order to achieve the desired improvements. The carrier oil is a chemically inert hydrocarbon-soluble liquid vehicle. The carrier oil of component (B) may be a synthetic oil or a mineral oil; for the instant invention, a refined petroleum oil is also understood to be a mineral oil.

Such carrier oils (also called carrier fluids) are believed to act as a carrier for the fuel additives and to assist in removing and retarding deposits. The carrier oil (B) may also exhibit synergistic deposit control and deposit removing properties when used in combination with components (A) and (C) of the instant fuel additive composition.

The carrier oil of component (B) is typically employed in amounts ranging from about 50 to about 2,000 ppm by weight of the gasoline fuel, preferably from 100 to 800 ppm of the gasoline fuel. Preferably, the ratio of carrier oil (B) to nitrogen-containing dispersant (A1), (A2) or (A3) in the fuel additive composition as well as in the gasoline fuel will range from 0.5:1 to 10:1, typically from 1:1 to 4:1.

Examples for suitable mineral carrier oils are in particular those of viscosity class Solvent Neutral (SN) 500 to 2000, as well as aromatic and paraffinic hydrocarbons and alkoxyalkanols. Another useful mineral carrier oil is a fraction known as "hydrocrack oil" which is obtained from refined mineral oil (boiling point of approximately 360 to 500° C.; obtainable from natural mineral oil which is isomerized, freed of paraffin components and catalytically hydrogenated under high pressure).

Examples for synthetic carrier oils which can be used for the instant invention are olefin polymers with a number average molecular weight of from 400 to 1800, based on poly-alpha-olefins or poly-internal-olefins, especially those based on polybutene or on polyisobutene (hydrogenated or nonhydrogenated). Further examples for suitable synthetic carrier oils are polyesters, polyalkoxylates, polyethers, alkylphenol-initiated polyethers, and carboxylic acids of long-chain alkanols.

Examples for suitable polyethers which can be used for the instant invention are compounds containing polyoxy-$C_2$-$C_4$-alkylene groups, especially polyoxy-$C_3$-$C_4$-alkylene groups, which can be obtained by reacting $C_1$-$C_{30}$-alkanols, $C_2$-$C_{60}$-alkandiols, $C_1$-$C_{30}$-alkylcyclohexanols or $C_1$-$C_{30}$-alkylphenols with 1 to 30 mol ethylene oxide and/or propylene oxide and/or butylene oxides per hydroxyl group, especially with 1 to 30 mol propylene oxide and/or butylene oxides per hydroxyl group. This type of compounds is described, for example, in EP-A 310 875, EP-A 356 725, EP-A 700 985 and U.S. Pat. No. 4,877,416.

Typical examples for suitable polyethers are tridecanol butoxylates, isotridecanol butoxylates, isononylphenol butoxylates, polyisobutenol butoxylates and polyisobutenol propoxylates.

Hydrocarbyl-terminated poly(oxyalkylene) polymers which may be employed in the present invention as component (B), are monohydroxy compounds, i.e., alcohols, and are often termed monohydroxy polyethers, or polyalkylene glycol monohydrocarbylethers, or "capped" poly(oxyalkylene).

The hydrocarbyl-terminated poly(oxyalkylene) alcohols may be produced by the addition of lower alkylene oxides, such as ethylene oxide, propylene oxide, the butylene oxides, or the pentylene oxides to the hydroxy compound under polymerization conditions. Methods of production and properties of these polymers are disclosed in U.S. Pat. Nos. 2,841,479 and 2,782,240 and Kirk-Othmer's "Encyclopedia of Chemical Technology", 2nd Ed. Volume 19, p. 507. In the polymerization reaction, a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular weight.

Examples of carboxylic esters of long-chain alkanols are esters of mono-, di- and tricarboxylic acids with long-chain alkanols or polyhydric alcohols such as described e.g. in DE-A 38 38 918. Suitable mono-, di- and tricarboxylic acids are aliphatic or aromatic carboxylic acids. Suitable alkanols and polyhydric alcohols contain 6 to 24 carbon atoms. Typical examples of such esters are the adipates, phthalates, isophthalates, terephthalates and trimellitates of isooctanol, isononanol, isodecanol and isotridecanol, e.g. di-n-tridecyl phthalate or di-iso-tridecyl phthalate.

Examples for particularly useful synthetic carrier oils are alcohol-initiated polyethers containing about 5 to 35, e.g. 5 to 30 $C_3$-$C_6$-alkylenoxide units, such as propylene oxide, n-butylene oxide and iso-butylene oxide units or mixtures thereof. Non-limiting examples for alcoholic starters are long-chain alkanols or phenols substituted by long-chain alkyl groups, where the alkyl group preferably is linear or branched $C_6$- to $C_{18}$-alkyl. Preferred examples for the alcoholic starters are tridecanol and nonylphenol.

Further suitable synthetic carrier oils are alkoxylated alkylphenols, such as described e.g. in DE-A 10 102 913.

Preferably, synthetic carrier oils are used. Preferred synthetic carrier oils are alkanol alkoxylates, in particular alkanol propoxylates and alkanol butoxylates.

In an especially preferred embodiment, carrier oil component (B) comprises at least one polyether obtained from $C_1$- to $C_{30}$-alkanols, especially $C_6$- to $C_{18}$-alkanols, or $C_2$- to $C_{60}$-alkandiols, especially $C_8$- to $C_{24}$-alkandiols, and from 1 to 30 mol, especially 5 to 30 mol, in sum, of propylene oxide and/or butylene oxides. Other synthetic carrier oils and/or mineral carrier oils may be present in component (B) in minor amounts.

The Amine (Component C)

Tertiary hydrocarbyl amines have proven to be more advantageous with regard to use as performance additives in fuels controlling deposits and modifying friction than for example the primary hydrocarbyl amines recommended in WO 03/076554 for the same purpose. Besides their unexpected superior performance behavior, they are also better to handle as their melting points are normally lower than the corresponding primary hydrocarbyl amines, thus being usually liquid at ambient temperature.

"Hydrocarbyl residue" for $R^1$ to $R^3$ in formula (I) for component (C) shall mean a residue which is essentially composed of carbon and hydrogen, however, it can contain in small amounts heteroatomes, especially oxygen and/or nitrogen, and/or functional groups, e.g. hydroxyl groups and/or carboxylic groups, to an extent which does not distort the predominantly hydrocarbon character of the residue. Hydrocarbyl residues are preferably alkyl, hydroxyalkyl, alkenyl, alkinyl, cycloalkyl, aryl, alkylaryl or arylalkyl groups. Especially preferred hydrocarbyl residues for $R^1$ to $R^3$ in formula (I) are linear or branched alkyl, hydroxyalkyl or alkenyl groups.

The overall number of carbon atoms in the tertiary hydrocarbyl amine (I) is at most 30, preferably at most 27, more preferably at most 24, still more preferably at most 22 and most preferably at most 20. Preferably, the minimum overall number of carbon atoms in formula (I) is 5, more preferably 6, still more preferably 8, most preferably 10. Such size of the tertiary hydrocarbyl amine (I) corresponds to molecular weight of about 100 to about 450 for the largest range and of about 150 to about 300 for the smallest range; most usually, tertiary hydrocarbyl amines (I) within a molecular range of from 100 to 360, especially of from 100 to 300, are used.

The three $C_1$- to $C_{20}$-hydrocarbyl residues may be identical or different. Preferably, they are different, thus creating an amine molecular which exhibits an oleophobic moiety (i.e. the more polar amino group) and an oleophilic moiety (i.e. a hydrocarbyl residue with a longer chain length or a larger volume). Such amine molecules with oleophobic/oleophilic balance have proved to show the best deposit control performance according the present invention. In some cases, the oleophobic moiety includes one or two short-chain hydroxyalkyl residues attached to the nitrogen atom, in order to intensify the oleophobic properties of this moiety.

In a preferred embodiment of the present invention, a tertiary hydrocarbyl amine (I) of component (C) is used wherein at least two of hydrocarbyl residues $R^1$, $R^2$ and $R^3$ are different with the proviso that the hydrocarbyl residue with the most carbon atoms differ in carbon atom number from the hydrocarbyl residue with the second most carbon atoms in at least 2, preferably in at least 3, more preferably in at least 4, still more preferably in at least 6, most preferably in at least 8. Thus, the tertiary amines (I) exhibit hydrocarbyl residues of two or three different chain length or different volume, respectively.

In a still more preferred embodiment of the present invention, a tertiary hydrocarbyl amine (I) of component (C) is used wherein one or two of $R^1$ to $R^3$ are $C_7$- to $C_{20}$-hydrocarbyl residues and the remaining two or one of $R^1$ to $R^3$ are $C_1$- to $C_4$-hydrocarbyl residues.

The one or the two longer hydrocarbyl residues, which may be in case of two residues identical or different, exhibit from 7 to 20, preferably from 8 to 18, more preferably from 9 to 16, most preferably from 10 to 14 carbon atoms, or, as an alternative, preferably from 10 to 20 and more preferably from 12 to 18 carbon atoms. The one or the two remaining shorter hydrocarbyl residues, which may be in case of two residues identical or different, exhibit from 1 to 4, preferably from 1 to 3, more preferably 1 or 2, most preferably 1 carbon atom(s). Besides the desired deposit controlling performance according to the instant invention, the oleophilic long-chain hydrocarbyl residues provide further advantageous properties to the amines, i.e. high solubility for gasoline fuels and low volatility.

In an especially preferred embodiment of the present invention, tertiary amines (C) of formula (I) are used, wherein $R^1$ is a $C_8$- to $C_{18}$-hydrocarbyl residue and $R^2$ and $R^3$ are independently of each other $C_1$- to $C_4$-alkyl radicals or $C_1$- to $C_4$-hydroxyalkyl radicals. Still more preferably, tertiary amines (C) of formula (I) are used, wherein $R^1$ is a $C_9$- to $C_{16}$-hydrocarbyl residue and $R^2$ and $R^3$ are each methyl radicals. Furthermore, preferably also tertiary amines (C) of formula (I) are used, wherein $R^1$ is a $C_{12}$- to $C_{18}$-hydrocarbyl residue and $R^2$ and $R^3$ are each 2-hydroxyethyl radicals.

In a further embodiment, preferably tertiary amines (C) of formula (I) are used, wherein $R^1$ is a $C_3$- to $C_{10}$-hydroxyalkyl residue, the hydroxyl group preferably being in omega-position, and $R^2$ and $R^3$ are each $C_1$- to $C_4$ alkyl radicals, preferably methyl radicals. Such $C_3$- to $C_{10}$-hydroxyalkyl-di($C_1$ to $C_4$-)alkylamines are especially useful for effectively reducing Injector nozzle fouling.

Examples for suitable linear or branched $C_1$- to $C_{20}$-alkyl residues for $R^1$ to $R^3$ are: methyl, ethyl, n-propyl, iso-propyl, n-butyl, iso-butyl, sec.-butyl, tert-butyl, n-pentyl, tert-pentyl, 2-methylbutyl, 3-methylbutyl, 1,1-dimethylpropyl, 1,2-dimethylpropyl, n-hexyl, 2-methylpentyl, 3-methylpentyl, 4-methylpentyl, 1,1-dimethylbutyl, 1,2-dimethylbutyl, 1,3-dimethylbutyl, 2-ethylbutyl, n-heptyl, 1-methylhexyl, 2-methylhexyl, 3-methylhexyl, 4-methylhexyl, 5-methylhexyl, 1,1-dimethylpentyl, 1,2-dimethylpentyl, 2,2-dimethylpentyl, 2,3-dimethylpentyl, 2,4-dimethylpentyl, 2,5-dimethylpentyl, 2-diethylpentyl, 3-diethyl-pentyl, n-octyl, 1-methylheptyl, 2-methylheptyl, 3-methylheptyl, 4-methylheptyl, 5-methylheptyl, 6-methylheptyl, 1,1-dimethylhexyl, 1,2-dimethylhexyl, 2,2-dimethylhexyl, 2,3-dimethylhexyl, 2,4-dimethyl-hexyl, 2,5-dimethylhexyl, 2,6-dimethylhexyl, 2-ethyl-hexyl, 3-ethylhexyl, 4-ethylhexyl, n-nonyl, iso-nonyl, n-decyl, 1-propylheptyl, 2-propyl-heptyl, 3-propyl-heptyl, n-undecyl, n-dodecyl, n-tridecyl, iso-tridecyl, tetradecyl, pentadecyl, hexadecyl, heptadecyl, octadecyl, nonadecyl and eicosyl.

Example for suitable hydroxyalkyl radicals are especially $C_1$- to $C_4$-hydroxyalkyl radicals such as hydroxymethyl, 2-hydroxypropyl, 3-hydroxypropyl, 2-hydroxybutyl, 3-hydroxybutyl, 4-hydroxybutyl, 2-hydroxy-2-methylpropyl, 3-hydroxy-2-methylpropyl and especially 2-hydroxyethyl. The said radicals may be generated by alkoxylation of long-chain primary or secondary amines with one molecule per N—H-bond of a $C_2$- to $C_4$-alkylene oxide such as ethylene oxide, propylene oxide or butylene oxide.

Examples for suitable linear or branched $C_2$- to $C_{20}$-alkenyl and -alkinyl residues for $R^1$ to $R^3$ are: vinyl, allyl, oleyl and propin-2-yl.

Tertiary amines (C) of formula (I) with long-chain alkyl and alkenyl residues can also preferably be obtained or derived from natural sources, i.e. from plant or animal oils and lards. The fatty amines derived from such sources which are suitable as tertiary amines of formula (I) of component (C) normally form mixtures of differents similar species such as homologues, e.g. tallow amines containing as main components tetra-decyl amine, hexadecyl amine, octadecyl amine and octadecenyl amine (oleyl amine). Further examples of suitable fatty amines are: coco amines and palm amines. Unsaturated fatty amines which contain alkenyl residues can be hydrogenated and used as component (C) in this saturated form.

Examples for suitable $C_3$- to $C_{20}$-cycloalkyl residues for $R^1$ to $R^3$ are: cyclopropyl, cyclobutyl, 2-methylcyclohexyl, 3-methylcyclohexyl, 4-methylcyclohexyl, 2,3-dimethyl-cyclohexyl, 2,4-dimethylcyclohexyl, 2,5-dimethylcyclohexyl, 2,6-dimethylcyclohexyl, 3,4-dimethylcyclohexyl, 3,5-dimethylcyclohexyl, 2-ethylcyclohexyl, 3-ethylcyclohexyl, 4-ethylcyclohexyl, cyclooctyl and cyclodecyl.

Examples for suitable $C_7$- to $C_{20}$-aryl, -alkylaryl or -arylalkyl residues for $R^1$ to $R^3$ are: naphthyl, tolyl, xylyl, n-octylphenyl, n-nonylphenyl, n-decylphenyl, benzyl, 1-phenylethyl, 2-phenylethyl, 3-phenylpropyl and 4-butylphenyl.

Typical examples for suitable tertiary amines (C) of formula (I) based are the following:

N,N-dimethyl-n-butylamine, N,N-dimethyl-n-pentylamine, N,N-dimethyl-n-hexylamine, N,N-dimethyl-n-heptylamine, N,N-dimethyl-n-octylamine, N,N-dimethyl-2-ethylhexyl-amine, N,N-dimethyl-n-nonylamine, N,N-dimethyl-iso-nonylamine, N,N-dimethyl-n-decylamine, N,N-dimethyl-2-propylheptylamine, N,N-dimethyl-n-undecylamine, N,N-dimethyl-n-dodecylamine, N,N-dimethyl-n-tridecylamine, N,N-dimethyl-iso-tridecyl-amine, N,N-dimethyl-n-tetradecylamine, N,N-dimethyl-n-hexadecylamine, N,N-di-methyl-n-octadecylamine, N,N-dimethyl-eicosylamine, N,N-dimethyl-oleylamine;

N,N-diethyl-n-heptylamine, N,N-diethyl-n-octylamine, N,N-diethyl-2-ethylhexylamine, N,N-diethyl-n-nonylamine, N,N-diethyl-iso-nonylamine, N,N-diethyl-n-decylamine, N,N-diethyl-2-propylheptylamine, N,N-diethyl-n-undecylamine, N,N-diethyl-n-dodecylamine, N,N-diethyl-n-tridecylamine, N,N-diethyl-iso-tridecylamine, N,N-diethyl-n-tetradecyl-amine, N,N-diethyl-n-hexadecylamine, N,N-di-ethyl-n-octadecylamine, N,N-diethyl-eicosylamine, N,N-diethyl-oleylamine;

N,N-di-(n-propyl)-n-heptylamine, N,N-di-(n-propyl)-n-octylamine, N,N-di-(n-propyl)-2-ethylhexylamine, N,N-di-(n-propyl)-n-nonylamine, N,N-di-(n-propyl)-iso-nonylamine, N,N-di-(n-propyl)-n-decylamine, N,N-di-(n-propyl)-2-propylheptylamine, N,N-di-(n-propyl)-n-undecylamine, N,N-di-(n-propyl)-n-dodecylamine, N,N-di-(n-propyl)-n-tri-decylamine, N,N-di-(n-propyl)-isotridecylamine, N,N-di-(n-propyl)-n-tetradecylamine, N,N-di-(n-propyl)-n-hexadecylamine, N,N-di(n-propyl)-n-octadecylamine, N,N-di-(n-propyl)-eicosylamine, N,N-di-(n-propyl)-oleylamine;

N,N-di-(n-butyl)-n-heptylamine, N,N-di-(n-butyl)-n-octylamine, N,N-di-(n-butyl)-2-ethylhexylamine, N,N-di-(n-butyl)-n-nonylamine, N,N-di-(n-butyl)-iso-nonylamine, N,N-di-(n-butyl)-n-decylamine, N,N-di-(n-butyl)-2-propylheptylamine, N,N-di-(n-butyl)-n-undecyl-amine, N,N-di-(n-butyl)-n-dodecylamine, N,N-di-(n-butyl)-n-tridecylamine, N,N-di-(n-butyl)-iso-tridecylamine, N,N-di-(n-butyl)-n-tetradecylamine, N,N-di-(n-butyl)-n-hexadecylamine, N,N-di-(n-butyl)-n-octadecylamine, N,N-di-(n-butyl)-eicosylamine, N,N-di-(n-butyl)-oleyl-amine;

N-methyl-N-ethyl-n-heptylamine, N-methyl-N-ethyl-n-octylamine, N-methyl-N-ethyl-2-ethylhexylamine, N-methyl-N-ethyl-n-nonylamine, N-methyl-N-ethyl-iso-nonylamine, N-methyl-N-ethyl-n-decylamine, N-methyl-N-ethyl-2-propylheptylamine, N-methyl-N-ethyl-n-undecylamine, N-methyl-N-ethyl-n-dodecylamine, N-methyl-N-ethyl-n-tridecylamine, N-methyl-N-ethyl-iso-tridecylamine, N-methyl-N-ethyl-n-tetradecylamine, N-methyl-N-ethyl-n-hexadecylamine, N-methyl-N-ethyl-n-octadecylamine, N-methyl-N-ethyl-eicosyl-amine, N-methyl-N-ethyl-oleylamine;

N-methyl-N-(n-propyl)-n-heptylamine, N-methyl-N-(n-propyl)-n-octylamine, N-methyl-N-(n-propyl)-2-ethylhexylamine, N-methyl-N-(n-propyl)-n-nonylamine, N-methyl-N-(n-propyl)-iso-nonylamine, N-methyl-N-(n-propyl)-n-decylamine, N-methyl-N-(n-propyl)-2-propylheptylamine, N-methyl-N-(n-propyl)-n-undecylamine, N-methyl-N-(n-propyl)-n-dodecylamine, N-methyl-N-(n-propyl)-n-tridecylamine, N-methyl-N-(n-propyl)-iso-tri-decylamine, N-methyl-N-(n-propyl)-n-tetradecylamine, N-methyl-N-(n-propyl)-n-hexa-decylamine, N-methyl-N-(n-propyl)-n-octadecylamine, N-methyl-N-(n-propyl)-eicosyl-amine, N-methyl-N-(n-propyl)-oleylamine; N-methyl-N-(n-butyl)-n-heptylamine, N-methyl-N-(n-butyl)-n-octylamine, N-methyl-N-(n-butyl)-2-ethylhexylamine, N-methyl-N-(n-butyl)-n-nonylamine, N-methyl-N-(n-butyl)-iso-nonylamine, N-methyl-N-(n-butyl)-n-decylamine, N-methyl-N-(n-butyl)-2-propylheptyl-amine, N-methyl-N-(n-butyl)-n-undecylamine, N-methyl-N-(n-butyl)-n-dodecylamine, N-methyl-N-(n-butyl)-n-tridecylamine, N-methyl-N-(n-butyl)-iso-tridecylamine, N-methyl-N-(n-butyl)-n-tetradecylamine, N-methyl-N-(n-butyl)-n-hexadecylamine, N-methyl-N-(n-butyl)-n-octadecylamine, N-methyl-N-(n-butyl)-eicosylamine, N-methyl-N-(n-butyl)-oleylamine;

N-methyl-N,N-di-(n-heptyl)-amine, N-methyl-N,N-di-(n-octyl)-amine, N-methyl-N,N-di-(2-ethylhexyl)-amine, N-methyl-N,N-di-(n-nonyl)-amine, N-methyl-N,N-di-(iso-nonyl)-amine, N-methyl-N,N-di-(n-decyl)-amine, N-methyl-N,N-di-(2-propylheptyl)-amine, N-methyl-N,N-di-(n-undecyl)-amine, N-methyl-N,N-di-(n-dodecyl)-amine, N-methyl-N,N-di-(n-tridecyl)-amine, N-methyl-N,N-di-(iso-tridecyl)-amine, N-methyl-N,N-di-(n-tetra-decyl)-amine;

N-ethyl-N,N-di-(n-heptyl)-amine, N-ethyl-N,N-di-(n-octyl)-amine, N-ethyl-N,N-di-(2-ethylhexyl)amine, N-ethyl-N,N-di-(n-nonyl)-amine, N-ethyl-N,N-di-(iso-nonyl)-amine, N-ethyl-N,N-di-(n-decyl)-amine, N-ethyl-N,N-di-(2-propylheptyl)-amine, N-ethyl-N,N-di-(n-undecyl)-amine, N-ethyl-N,N-di-(n-dodecyl)-amine, N-ethyl-N,N-di-(n-tridecyl)-amine, N-ethyl-N,N-di-(iso-tridecyl)-amine, N-ethyl-N,N-di-(n-tetradecyl)-amine;

N-(n-butyl)-N,N-di-(n-heptyl)-amine, N-(n-butyl)-N,N-di-(n-octyl)-amine, N-(n-butyl)-N,N-di-(2-ethylhexyl)-amine, N-(n-butyl)-N,N-di-(n-nonyl)-amine, N-(n-butyl)-N,N-di-(iso-nonyl)-amine, N-(n-butyl)-N,N-di-(n-decyl)-amine, N-(n-butyl)-N,N-di-(2-propylheptyl)-amine, N-(n-butyl)-N,N-di(n-undecyl)-amine, N-(n-butyl)-N,N-di-(n-dodecyl)-amine, N-(n-butyl)-N,N-di-(n-tridecyl)-amine, N-(n-butyl)-N, N-di-(iso-tridecyl)-amine;

N-methyl-N-(n-heptyl)-N-(n-dodecyl)-amine, N-methyl-N-(n-heptyl)-N-(n-octadecyl)-amine, N-methyl-N-(n-octyl)-

N-(2-ethylhexyl)-amine, N-methyl-N-(2-ethylhexyl)-N-(n-dodecyl)-amine, N-methyl-N-(2-propylheptyl)-N-(n-undecyl)-amine, N-methyl-N-(n-decyl)-N-(n-dodecyl)-amine, N-methyl-N-(n-decyl)-N-(n-tetradecyl)-amine, N-methyl-N-(n-decyl)-N-(n-hexadecyl)-amine, N-methyl-N-(n-decyl)-N-(n-octadecyl)-amine, N-methyl-N-(n-decyl)-N-oleylamine, N-methyl-N-(n-dodecyl)-N-(iso-tridecyl)-amine, N-methyl-N-(n-dodecyl)-N-(n-tetradecyl)-amine, N-methyl-N-(n-dodecyl)-N-(n-hexadecyl)-amine, N-methyl-N-(n-dodecyl)-oleylamine;

3-(N,N-dimethyl)-propan-1-ol, 3-(N,N-dimethyl)-propan-2-ol, 4-(N,N-dimethyl)butan-1-ol, 4-(N,N-dimethyl)-butan-2-ol, 4-(N,N-dimethyl)-2-methylpropan-2-ol, 5-(N,N-dimethyl)-pentan-1-ol, 6-(N,N-dimethyl)-hexan-1-ol, 7-(N,N-dimethyl)-heptan-1-ol, 8-(N,N-dimethyl)-octan-1-ol-, 9-(N,N-dimethyl)-nonan-1-ol, 10-(N,N-dimethyl)-decan-1-ol;

N-methyl-N-hydroxyethyl-n-heptylamine, N-methyl-N-hydroxyethyl-n-octylamine, N-methyl-N-hydroxyethyl-2-ethylhexylamine, N-methyl-N-hydroxyethyl-n-nonylamine, N-methyl-N-hydroxyethyl-iso-nonylamine, N-methyl-N-hydroxyethyl-n-decylamine, N-methyl-N-hydroxyethyl-2-propylheptylamine, N-methyl-N-hydroxyethyl-n-undecylamine, N-methyl-N-hydroxyethyl-n-dodecylamine, N-methyl-N-hydroxyethyl-n-tridecylamine, N-methyl-N-hydroxyethyl-isotridecylamine, N-methyl-N-hydroxyethyl-n-tetradecyl-amine, N-methyl-N-hydroxyethyl-n-hexadecylamine, N-methyl-N-hydroxyethyl-n-octadecylamine, N-methyl-N-hydroxyethyl-eicosylamine, N-methyl-N-hydroxyethyl-oleylamine;

N,N-di-(2-hydroxyethyl)-n-heptylamine, N,N-di-(2-hydroxyethyl)-n-octylamine, N,N-di-(2-hydroxyethyl)-2-ethylhexylamine, N,N-di-(2-hydroxyethyl)-n-nonylamine, N,N-di-(2-hydroxyethyl)-iso-nonylamine, N,N-di-(2-hydroxyethyl)-n-decylamine, N,N-di-(2-hydroxyethyl)-2-propylheptylamine, N,N-di-(2-hydroxyethyl)-n-undecylamine, N,N-di-(2-hydroxyethyl)-n-dodecylamine, N,N-di-(2-hydroxyethyl)-n-tridecylamine, N,N-di-(2-hydroxyethyl)-isotridecylamine, N,N-di-(2-hydroxyethyl)-n-tetradecyl-amine, N,N-di-(2-hydroxyethyl)-n-hexadecylamine, N,N-di-(2-hydroxyethyl)-n-octadecylamine, N,N-di-(2-hydroxyethyl)-eicosylamine, N,N-di-(2-hydroxyethyl)-oleylamine.

Long-chain N,N-di-(2-hydroxyethyl)-alkylamines which are based on natural sources are available under the tradename of Ethomeen®, such as Ethomeen® O/12 which comprises N,N-di-(2-hydroxyethyl)-oleylamine or Ethomeen® C/12 which is a mixture of N,N-di-(2-hydroxyethyl)-$C_6$- to $C_{18}$-alk(en)ylamines with predominantly saturated $C_6$- to $C_{18}$-radicals (saturated $C_{12}/C_{14}$ prevailing).

Also suitable tertiary amines of formula (I) for component (C) are monocyclic structures, wherein one of the short-chain hydrocarbyl residue forms with the nitrogen atom and with the other short-chain hydrocarbyl residue a five- or six-membered ring. Oxygen atoms and/or further nitrogen atoms may additionally be present in such five- or six-membered ring. In each case, such cyclic tertiary amines carry at the nitrogen atom or at one of the nitrogen atoms, respectively, the long-chain $C_7$- to $C_{20}$-hydrocarbyl residue. Examples for such monocyclic tertiary amines are N—($C_7$- to $C_{20}$-hydrocarbyl)-piperidines, N—($C_7$- to $C_{20}$-hydrocarbyl)-piperazines and N—($C_7$- to $C_{20}$-hydrocarbyl)morpholines.

The Friction Modifier (Component D)

Suitable further friction modifier components (D), which are sometimes also called lubricity additives, if any, are usually selected from fatty acids, alkenylsuccinic esters, bis-(hydroxyalkyl)fatty amines, hydroxylacetamides or castor oil. Such products are commerically available. Special suitable friction modifiers are also the reaction products from carboxylic acids and alkanolamines, as described in WO 2009/050256, and nitrogen-containing heterocycles such as tolutriazoles, as described in WO 2006/015800.

The Fuel Additive Composition

The present fuel additive composition of component (A), (B), (C) and optionally (D) normally comprises from 5 to 75% by weight, preferably from 25 to 50% by weight of (A), from 5 to 75% by weight, preferably from 25 to 50% by weight of (B), from 1 to 90% by weight, preferably from 2 to 25% by weight of (C) and from 0 to 40% by weight, preferably from 0.5 to 40% by weight of (D). In each case, the sum of the amounts of all four components (A), (B), (C) and (D) results in 100% by weight.

The present fuel additive composition may be formulated as a concentrate, using an inert stable oleophilic (i.e., dissolves in fuel) organic solvent boiling in the range of about 65° C. to 300° C. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol, 2-ethylhexanol, and the like, in combination with hydrocarbon solvents, are also suitable for use in such concentrate. In the concentrate, the amount of the present fuel additive composition of components (A), (B), (C) and optionally (D) will be ordinarily at least 10% by weight to about 90% by weight, as for example 40 to 85 weight percent or 50 to 80 weight percent.

In gasoline fuels, other fuel additives may be employed with the additives of the present invention, including, for example, oxygenates, such as tert.-butyl methyl ether, anti-knock agents, such as methylcyclopentadienyl manganese tricarbonyl, and other dispersants/detergents, such as various hydrocarbyl amines, or succinimides. A list of suitable other detergent additives is for example given in WO 00/47698 or in EP-A 1 155 102.

Also included may be lead scavengers, such as aryl halides, e.g., dichlorobenzene, or alkyl halides, e.g., ethylene dibromide. In addition, antioxidants, metal deactivators, pour point depressants, corrosion inhibitors and demulsifiers may be present.

Preferably, the weight ratio of dispersant component (A) to amine component (C) is in the range of from 0.3:1 to 25:1, especially of from 1:1 to 15:1, thus providing the best improvement of deposit control performance of gasoline fuels.

An interaction between components (A), (B), (C) and optionally (D) is necessary to achieve the desired improvement in deposit control performance. In the instant fuel additive composition, the tertiary amine (C) may exhibit a synergistic effect in this respect when used in combination with components (A), (B) and optionally (D) of the present fuel additive composition.

The Fuel Composition

The fuel additive composition of the present invention will generally be employed in a liquid hydrocarbon distillate fuel boiling in the gasoline range. It is in principle suitable for use in all types of gasoline, including "light" and "severe" gasoline species. The gasoline fuels may also contain amounts of other fuels such as, for example, ethanol.

The proper concentration of the instant fuel additive composition necessary in order to achieve the desired intake valve clean-up performance varies depending upon the type of fuel employed, and may also be influenced by the presence of other detergents, dispersants and other additives, etc. Generally, however, from 200 to 10.000 weight ppm by weight, especially from 400 to 2800 weight ppm by weight, of the instant fuel additive composition of components (A), (B), (C) and optionally (D) per part of base fuel is needed to achieve the best results.

In a preferred embodiment of the present invention, dispersant component (A) is present in the present fuel composition at a level of from more than 50 to 3000 ppm, preferably from 75 to 1000 ppm, more preferably from 100 to 750 ppm, most preferably from 125 to 500 ppm, carrier oil component (B) at a level of from 50 to 2000 ppm, preferably from 75 to 800 ppm, more preferably from 100 to 600 ppm, most preferably from 125 to 400 ppm, hydrocarbyl amine component (C) at a level of from 10 to 3000 ppm, preferably from 20 to 1000 ppm, more preferably from 30 to 500 ppm, most preferably from 45 to 300 ppm, and friction modifier component (D), if present, at a level of from 5 to 2000 ppm, preferably from 10 to 800 ppm, more preferably from 25 to 500 ppm, most preferably from 40 to 300 ppm. All ppm values above refer to the weight.

Typically, gasoline fuels, which may be used according to the present invention exhibit, in addition, one or more of the following features:

The aromatics content of the gasoline is preferably not more than 50 volume % and more preferably not more than 45 volume %. Preferred ranges for the aromatics content are from 1 to 45 volume % and particularly from 5 to 40 volume %.

The sulfur content of the gasoline is preferably not more than 100 ppm by weight and more preferably not more than 50 ppm by weight. Preferred ranges for the sulfur content are from 0.5 to 150 ppm by weight and particularly from 1 to 100 ppm by weight.

The gasoline has an olefin content of not more than 21 volume %, preferably not more than 18 volume %, and more preferably not more than 10 volume %. Preferred ranges for the olefin content are from 0.1 to 21 volume % and particularly from 2 to 18 volume %.

The gasoline has a benzene content of not more than 1.0 volume % and preferably not more than 0.9 volume %. Preferred ranges for the benzene content are from 0 to 1.0 volume % and preferably from 0.05 to 0.9 volume %.

The gasoline has an oxygen content of not more than 45 weight %, preferably from 0 to 45 weight %, and most preferably from 0.1 to 2.7 weight % (first type) or most preferably from 2.7 to 45 weight % (second type). The gasoline of the second type mentioned above is a mixture of lower alcohols such as methanol or especially ethanol, which derive preferably from natural source like plants, with mineral oil based gasoline, i.e. usual gasoline produced from crude oil. An example for such gasoline is "E 85", a mixture of 85 volume % of ethanol with 15 volume % of mineral oil based gasoline. Also a fuel containing 100% of a lower alcohol, especially ethanol, is suitable.

The content of alcohols, especially lower alcohols, and ethers in a gasoline of the first type mentioned in the above paragraph is normally relatively low. Typical maximum contents are for methanol 3 volume %, for ethanol 5 volume %, for isopropanol 10 volume %, for tert-butanol 7 volume %, for iso-butanol 10 volume %, and for ethers containing 5 or more carbon atoms in the molecule 15 volume %.

For example, a gasoline which has an aromatics content of not more than 38 volume % and at the same time an olefin content of not more than 21 volume %, a sulfur content of not more than 50 ppm by weight, a benzene content of not more than 1.0 volume % and an oxygen content of from 0.1 to 2.7 weight % may be applied.

The summer vapor pressure of the gasoline is usually not more than 70 kPa and preferably not more than 60 kPa (at 37° C.).

The research octane number ("RON") of the gasoline is usually from 90 to 100. A usual range for the corresponding motor octane number ("MON") is from 80 to 90.

The above characteristics are determined by conventional methods (DIN EN 228).

EXPERIMENTAL PART

The following examples are presented to illustrate specific embodiments of this invention and are not to be construed in any way as limiting the scope of the invention.

Determination of injector cleanliness with a direct injection spark ignition engine:

According to an internal BASF test procedure, a loaded commercially available four-cylinder direct injection spark ignition engine (1.6 liters cylinder capacity) was run with a commercially available gasoline fuel (according to DIN EN 228) containing 7 volume % of oxygen-containing components, during 60 hours. In Run 1, the fuel contained 50 ppm by weight of N,N-dimethyl-n-dodecylamine; in Run 2 (for comparison), the same fuel did not contain any tertiary hydrocarbyl amine (I). Furthermore, the fuel used contained 150 ppy by weight of a usual nitrogen-containing dispersant (A), 185 ppm by weight of a usual carrier oil and 75 ppm by weight of a usual friction modifier (D).

Further Runs 3 to 5 under the same conditions as above (except for 50 hours instead of 60 hours) with a similar gasoline fuel were carried through. In Run 3, the fuel contained 100 ppm by weight of 3-(N,N-dimethylamino)-propan-1-ol; in Run 4 the fuel contained 100 ppm by weight of N,N-di-(2-hydroxyethyl)-oleylamine (Ethomeen® O/12); in Run 5 (for comparison), the fuel did not contain any tertiary hydrocarby amine (I).

In both Runs, the "FR" value was determined. FR is a parameter generated by engine steering, corresponding to the time of the process of injection of the fuel into the combustion chamber. If FR increases during a run, the injection nozzles suffer deposits, the more increase the more deposits. If FR is kept constant or slightly decreases compared during a run, the injection nozzles stays free of deposits.

The following table shows the FR results of Runs 1 to 5:

| | | |
|---|---|---|
| Run 1 (according to the invention) | at the beginning: 1.03 | at the end: 1.05 |
| Run 2 (for comparison) | at the beginning: 0.99 | at the end: 1.03 |
| Run 3 (according to the invention) | at the beginning: 1.00 | at the end: 0.95 |
| Run 4 (according to the invention) | at the beginning: 0.98 | at the end: 0.97 |
| Run 5 (for comparison) | at the beginning: 0.98 | at the end: 1.08 |

The invention claimed is:

1. A process, comprising:

reducing or inhibiting injector nozzle fouling of a direct injection spark ignition engine by adding a fuel additive composition comprising an effective concentration of a tertiary hydrocarbyl amine of formula (I):

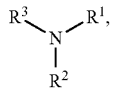

(I)

to an unleaded gasoline composition, to obtain a fuel composition; and introducing the fuel composition into the direct injection spark ignition engine, wherein, in formula (I):

$R^1$ is a $C_{12}$- to $C_{18}$-hydrocarbyl group;

$R^2$ is a 2-hydroxyethyl radical; and $R^3$ is a 2-hydroxyethyl radical.

2. The process of claim 1, wherein the fuel additive composition, further comprises:

(A) at least one nitrogen-containing dispersant selected from the group consisting of (A1) a polyisobutenyl monoamine, (A2) a polyisobutenyl polyamine, (A3) a Mannich reaction product of a substituted phenol with an aldehyde and a mono- or a polyamine, and (A4) a polyoxyalkylene which is terminated by a mono- or polyamino group;

(B) in case of presence of (A1), (A2) or (A3), at least one carrier oil which is substantially free of nitrogen, and which is a synthetic carrier oil or a mineral carrier oil; and (C) optionally, at least one friction modifier.

3. The process of claim 2, wherein dispersant component (A) is a polyisobutenyl monoamine (A1) with a number average molecular weight of from 550 to 1000.

4. The process of claim 2, wherein a weight ratio of dispersant component (A) to the hydrocarbyl amine of formula (I) ranges from 0.3:1 to 25:1.

5. The process of claim 1, wherein the fuel composition comprises a major amount of a liquid fuel in gasoline boiling range and a minor amount of the fuel additive composition.

6. The process of claim 5, wherein:

the dispersant (A) is present at a level of from more than 50 to 3000 ppm;

the carrier oil (B), if present, is present at a level of from 50 to 2000 ppm;

the hydrocarbyl amine of formula (I) is present at a level of from 10 to 3000 ppm; and the friction modifier (C), if present, is present at a level of from 5 to 2000 ppm.

7. The process of claim 3, wherein a weight ratio of dispersant component (A) to the hydrocarbyl amine of formula (I) ranges from 0.3:1 to 25:1.

8. The process of claim 1, wherein the tertiary hydrocarbyl amine of formula (I) is N,N-di-(2-hydroxyethyl)-oleylamine.

* * * * *